US011740649B2

(12) United States Patent
Hosono et al.

(10) Patent No.: US 11,740,649 B2
(45) Date of Patent: Aug. 29, 2023

(54) MULTIDIRECTIONAL INPUT DEVICE

(71) Applicant: ALPS ALPINE CO., LTD., Tokyo (JP)

(72) Inventors: Kunio Hosono, Miyagi (JP); Masaru Komatsu, Miyagi (JP); Sadayuki Yaginuma, Miyagi (JP); Yasuji Hagiwara, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 3 days.

(21) Appl. No.: 17/643,902

(22) Filed: Dec. 13, 2021

(65) Prior Publication Data

US 2022/0100223 A1 Mar. 31, 2022

Related U.S. Application Data

(63) Continuation of application No. PCT/JP2020/023065, filed on Jun. 11, 2020.

(30) Foreign Application Priority Data

Jun. 19, 2019 (JP) ..... 2019-113912

(51) Int. Cl.
*G05G 9/047* (2006.01)

(52) U.S. Cl.
CPC ... *G05G 9/047* (2013.01); *G05G 2009/04725* (2013.01); *G05G 2009/04748* (2013.01); *G05G 2009/04762* (2013.01)

(58) Field of Classification Search
CPC ..... G05G 9/047; G05G 2009/04725; G05G 2009/04762; G05G 2009/04777
See application file for complete search history.

(56) References Cited

U.S. PATENT DOCUMENTS 5,659,334 A * 8/1997 Yaniger ..... G05G 9/047 345/161
5,754,167 A * 5/1998 Narusawa ..... G05G 9/047 345/161

(Continued)

FOREIGN PATENT DOCUMENTS

GB 2509091 A * 6/2014 ..... B64C 13/0421
JP 2000-250649 9/2000

(Continued)

OTHER PUBLICATIONS

USPTO Machine Translation (retrieved from FIT database) of JP 2013065398 A, Uchida, Apr. 11, 2013. (Year: 2023).*

(Continued)

*Primary Examiner* — Daniel D Yabut
(74) *Attorney, Agent, or Firm* — IPUSA, PLLC

(57) ABSTRACT

A multidirectional input device includes an operation input part, a base, and a load detector. The operation input part includes an operation stick, two coupled parts configured to convert a tilt of the operation stick into two rotation angles orthogonal to each other, at least one return spring configured to return the operation stick to an upright position, and a frame accommodating the two coupled parts, the at least one return spring, and a part of the operation stick. The base has a plate shape and is provided below the frame. The load detector is provided on the frame or the base and is configured to detect a load applied to the frame.

7 Claims, 8 Drawing Sheets

(56) References Cited

U.S. PATENT DOCUMENTS

| | | | | |
|---|---|---|---|---|
| 6,293,160 | B1 * | 9/2001 | Shigemoto | G06F 3/0338 73/862.632 |
| 7,199,314 | B2 * | 4/2007 | Huang | G05G 9/04796 345/161 |
| 10,770,247 | B1 * | 9/2020 | Wu | H01H 23/04 |
| 11,042,179 | B1 * | 6/2021 | Muranaka | G05G 5/05 |
| 2003/0016209 | A1 * | 1/2003 | Narusawa | G06F 3/0338 345/168 |
| 2013/0051889 | A1 | 2/2013 | Kimura et al. | |
| 2017/0212514 | A1 * | 7/2017 | Taylor | G05G 1/04 |

FOREIGN PATENT DOCUMENTS

| | | |
|---|---|---|
| JP | 2013-047871 | 3/2013 |
| JP | 2013-065398 | 4/2013 |

OTHER PUBLICATIONS

International Search Report for PCT/JP2020/023065 dated Sep. 15, 2020.

* cited by examiner

MULTIDIRECTIONAL INPUT DEVICE

CROSS-REFERENCE TO RELATED APPLICATIONS

This application is a continuation of International Application No. PCT/JP2020/023065, filed on Jun. 11, 2020 and designating the U.S., which claims priority to Japanese Patent Application No. 2019-113912, filed on Jun. 19, 2019. The contents of these applications are incorporated herein by reference in their entirety.

BACKGROUND OF THE INVENTION

1. Field of the Invention

The disclosure herein relates to a multidirectional input device.

2. Description of the Related Art

Multidirectional input devices tiltable with an operating member have been known as, for example, multidirectional input devices used for game machines and the like. For example, Patent Document 1 below describes, with respect to a movable body controller that can control a movable body such as a vehicle, a technique to control a movable body according to an angle of operation detected with a rotation detecting sensor in a tilt area within a predetermined angle from the neutral position of an operating member and control the movable body by detecting the operating force of the operating member with a pressure sensor when the operating member is further operated.

However, with the technique described in Patent Document 1, if the operating member is not in an exact neutral position when not operated, it is difficult to determine whether the operating member is in an origin position (that is, a non-operating position) based on the output of the rotation detecting sensor.

RELATED-ART DOCUMENTS

Patent Documents

Patent Document 1: Japanese Laid-open Patent Publication No. 2000-250649

SUMMARY OF THE INVENTION

According to an embodiment of the present invention, a multidirectional input device includes an operation input part, a base, and a load detector. The operation input part includes an operation stick, two coupled parts configured to convert a tilt of the operation stick into two rotation angles orthogonal to each other, at least one return spring configured to return the operation stick to an upright position, and a frame accommodating the two coupled parts, the at least one return spring, and a part of the operation stick. The base has a plate shape and is provided below the frame. The load detector is provided on the frame or the base and is configured to detect a load applied to the frame.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

Figure 1:
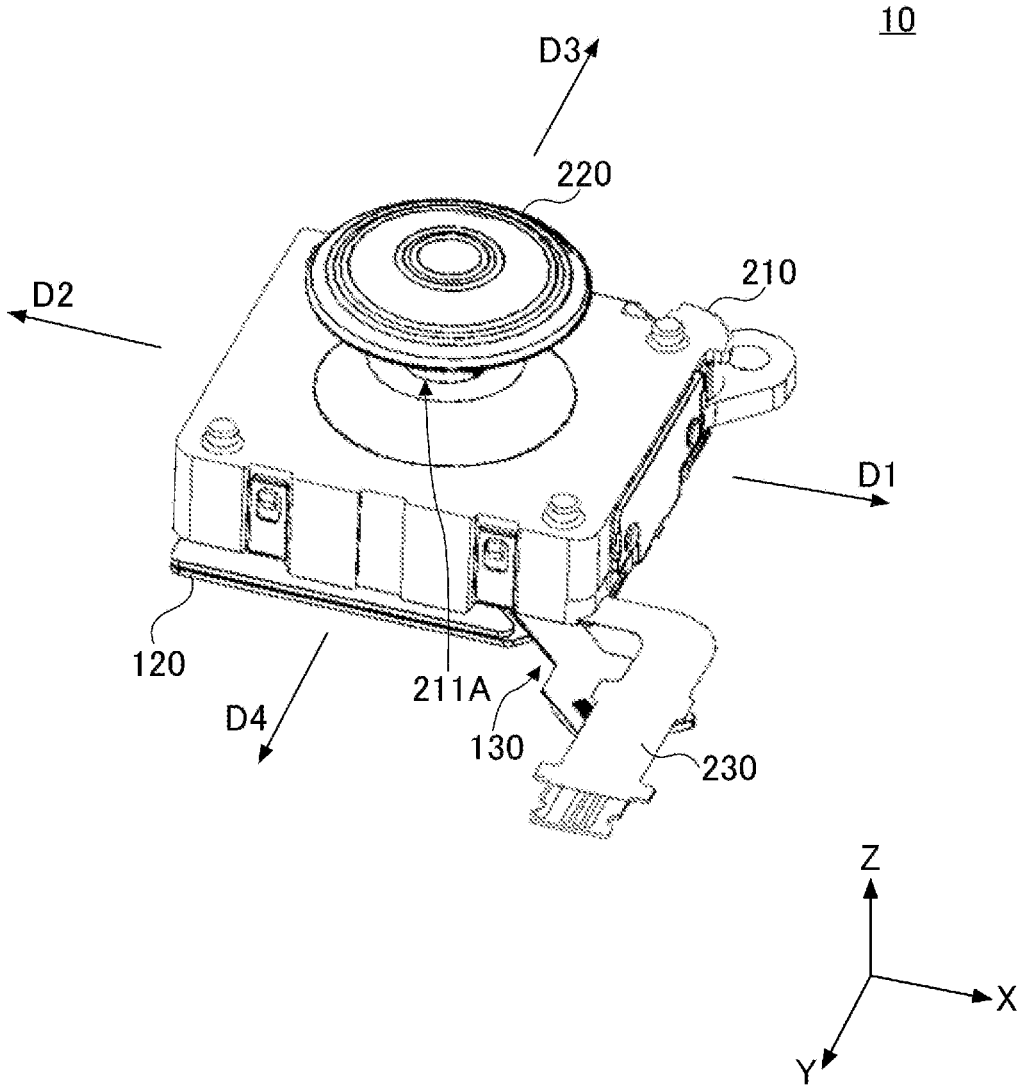
FIG. 1 is a top-side perspective view of a multidirectional input device according to a first embodiment.

According to an embodiment of the present invention, whether or not an operating member is in an origin position can be readily determined.

First Embodiment

A first embodiment will be described with reference to FIG. 1 through FIG. 6. In the following description, the Z axis direction in the drawings is referred to as an upper-lower direction, the X axis direction in the drawings is referred to as a front-rear direction, and the Y axis direction in the drawings is referred to as a left-right direction for the sake of convenience.

(Overview of Multidirectional Input Device 10)

Figure 2:
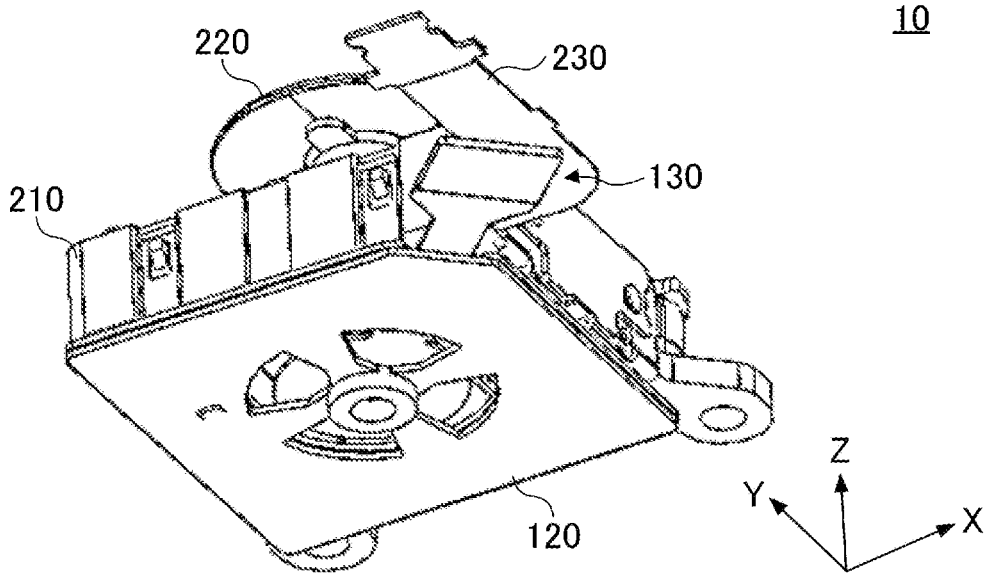
FIG. 2 is a bottom-side perspective view of the multidirectional input device according to the first embodiment.

FIG. 1 is a top-side perspective view of a multidirectional input device 10 according to a first embodiment. FIG. 2 is a bottom-side perspective view of the multidirectional input device 10 according to the first embodiment.

The multidirectional input device 10 is an input device used for the controller or the like of a game machine or the like. As illustrated in FIGS. 1 and 2, the multidirectional input device 10 includes a case 210, an operating member 220, and a flexible printed circuit (FPC) 230.

The case 210 is an example of a "frame". The case 210 is a box-shaped member that supports the operating member 220 in a tiltable manner. The operating member 220 is an example of an "operation stick". The operating member 220 protrudes upward through an opening 211A formed in the center of the top of the case 210 to be tilted by a user. The FPC 230 is a flexible interconnect member having a film shape extended from the inside to the outside of the case 210.

The multidirectional input device 10 allows the operating member 220 to tilt in the front-rear direction (directions of arrows D1 and D2 in the drawings) and in the left-right direction (directions of arrows D3 and D4 in the drawings). Furthermore, the multidirectional input device 10 allows the operating member 220 to also perform tilting that is a combination of tilting in the front-rear direction and tilting in the left-right direction.

Furthermore, the multidirectional input device 10 can output a rotation angle detection signal in the X axis direction (the front-rear direction) and a rotation angle detection signal in the Y axis direction (the left-right direction) to the outside through the FPC 230 as an operation signal corresponding to the tilting (tilt direction and tilt angle) of the operating member 220.

Furthermore, as illustrated in FIGS. 1 and 2, the multidirectional input device 10 includes a base 120 having a plate shape and provided below the case 210 and a load detector 130 provided between the case 210 and the base 120. The multidirectional input device 10 can detect distortion caused in the base 120 by a load applied to the case 210, using the load detector 130, and output a distortion detection signal representing the detected distortion to the outside.

(Configuration of Multidirectional Input Device 10)

Figure 3:
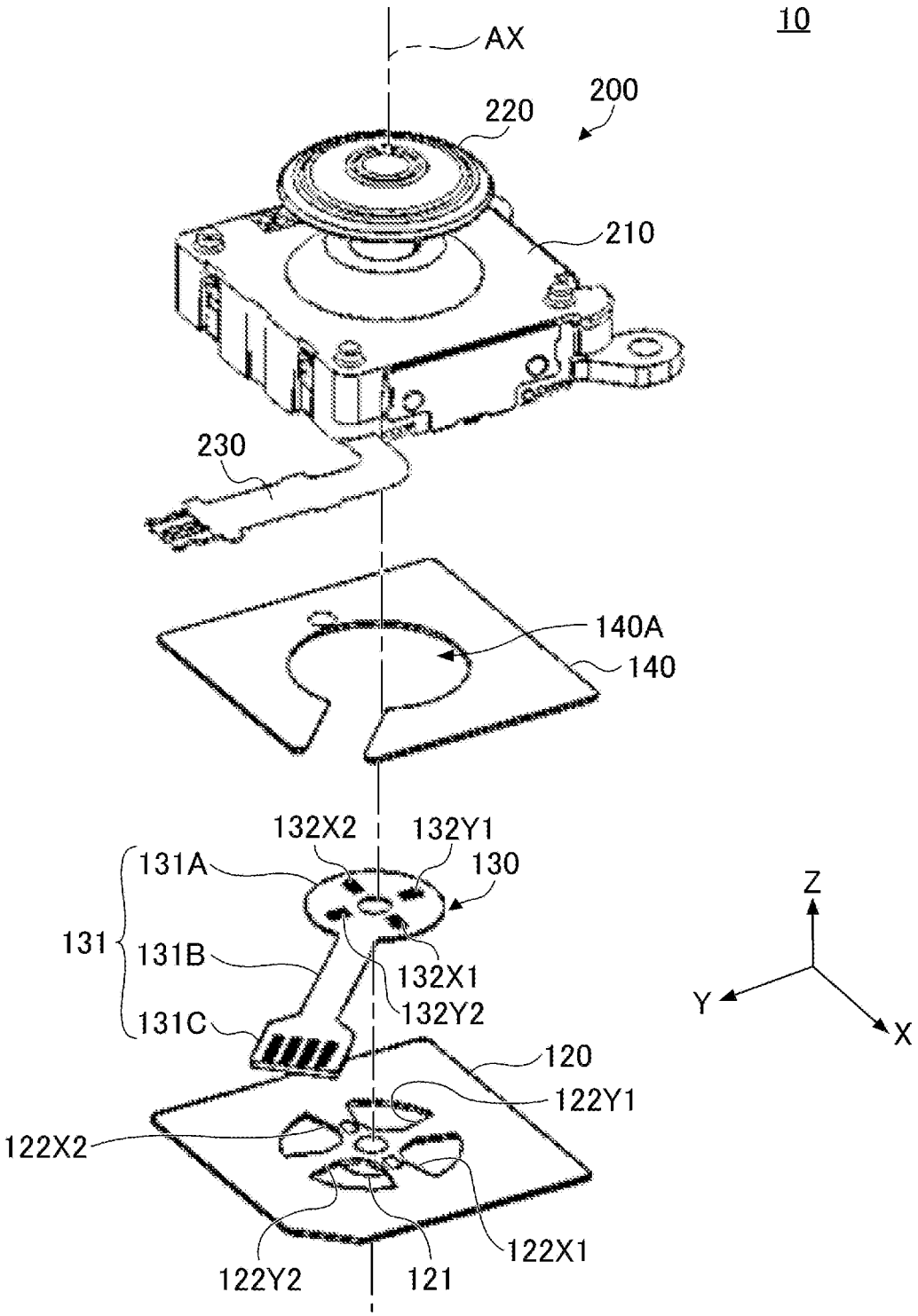
FIG. 3 is an exploded perspective view of the multidirectional input device according to the first embodiment.
Figure 4:
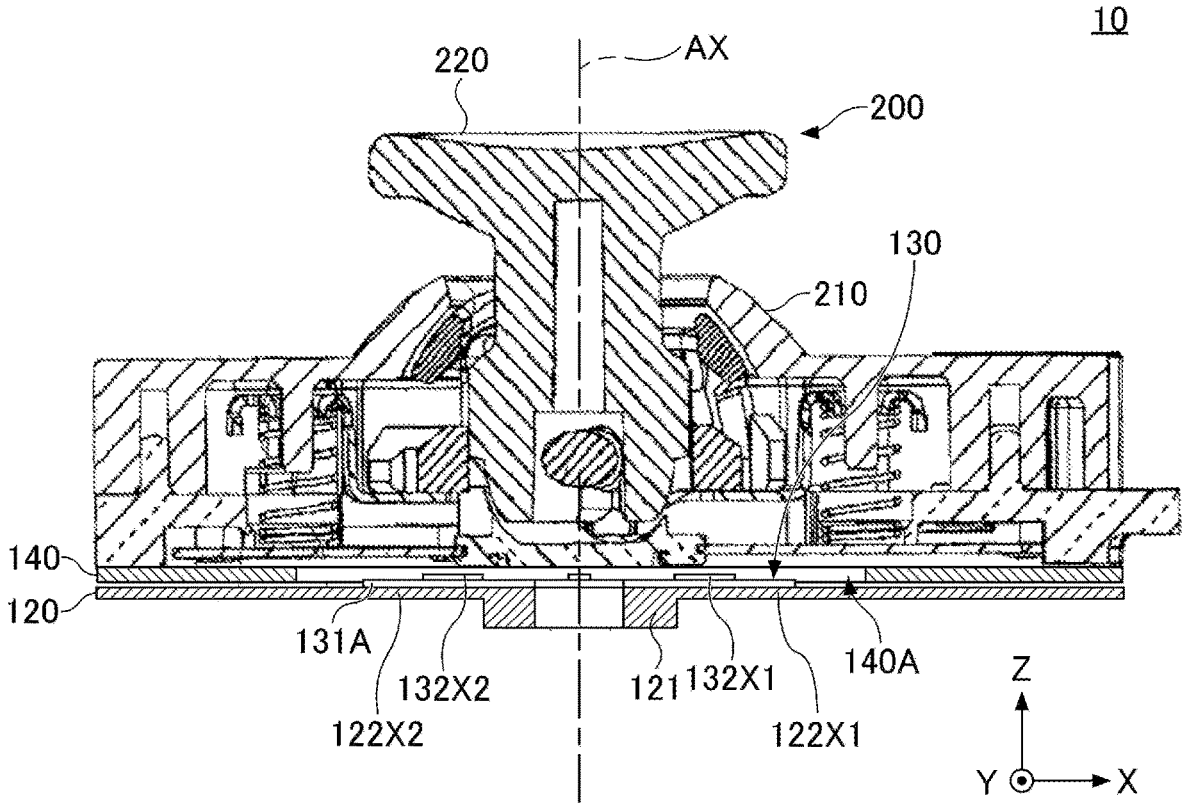
FIG. 4 is a cross-sectional view of the multidirectional input device according to the first embodiment.

FIG. 3 is an exploded perspective view of the multidirectional input device 10 according to the first embodiment. FIG. 4 is a cross-sectional view of the multidirectional input device 10 according to the first embodiment. As illustrated in FIGS. 3 and 4, the multidirectional input device 10 includes, in order from top to bottom, an operation input part 200, a spacer 140, the load detector 130, and the base 120.

As described with reference to FIGS. 1 and 2, the operation input part 200 includes the case 210, the operating member 220, and the FPC 230, and is where tilting is performed with the operating member 220. The operation input part 200 is what is known as an analog controller that can output an operation signal commensurate with the direction of operation and the amount of operation of the operating member 220. A detailed configuration of the operation input part 200 will be described later with reference to FIG. 5.

The base 120 is a flat plate-shaped member attached to the bottom of the case 210 of the operation input part 200. The base 120 is fixed to the case 210 by a desired fixing method. The base 120 includes a columnar part 121 and four beam parts 122X1, 122X2, 122Y1, and 122Y2.

The columnar part 121 has a cylindrical shape and is provided at the center of the base 120 (coaxially with a central axis AX of the operating member 220) so as to protrude downward. When the multidirectional input device 10 is mounted on an external mounting surface, the bottom surface of the columnar part 121 is fixed to the mounting surface.

The four beam parts 122X1, 122X2, 122Y1, and 122Y2 support the upper end of the columnar part 121 from four directions. Specifically, the beam part 122X1 supports the upper end of the columnar part 121 from the front side (the +X axis side) of the columnar part 121. The beam part 122X2 supports the upper end of the columnar part 121 from the rear side (the −X axis side) of the columnar part 121. The beam part 122Y1 supports the upper end of the columnar part 121 from the left side (the −Y axis side) of the columnar part 121. The beam part 122Y2 supports the upper end of the columnar part 121 from the right side (+Y axis side) of the columnar part 121.

The load detector 130 is provided between the operation input part 200 and the base 120. The load detector 130 detects distortions caused in the base 120 by a load applied to the case 210, and outputs distortion detection signals representing the detected distortions to the outside. The load detector 130 includes an FPC 131 and four distortion sensors 132X1, 132X2, 132Y1, and 132Y2.

The FPC 131 is a flexible interconnect member having a film shape. The FPC 131 includes a base part 131A, a lead part 131B, and a connection part 131C. The base part 131A has a circular shape, and is placed below the center of the bottom of the case 210 (coaxially with the central axis AX of the operating member 220). The four distortion sensors 132X1, 132X2, 132Y1, and 132Y2 are placed on the base part 131A. The lead part 131B extends horizontally and rectilinearly from the base part 131A to the outside of the case 210. The connection part 131C is provided at the tip of the lead part 131B for external connection (to a connector or the like). The FPC 131 outputs distortion detection signals output from the four distortion sensors 132X1, 132X2, 132Y1, and 132Y2 to the outside from the connection part 131C.

The four distortion sensors 132X1, 132X2, 132Y1, and 132Y2 are placed in four directions with respect to the central axis AX on the base part 131A of the FPC 131, and detect distortion caused in the base 120 by the transmission of a load applied to the case 210 to the base 120.

Specifically, the distortion sensor 132X1 is placed over the beam part 122X1 on the front side (the positive side of the X axis) of the central axis AX on the base part 131A. The distortion sensor 132X1 detects distortion caused in the beam part 122X1 and outputs a distortion detection signal representing the distortion.

The distortion sensor 132X2 is placed over the beam part 122X2 on the rear side (the negative side of the X axis) of the central axis AX on the base part 131A. The distortion sensor 132X2 detects distortion caused in the beam part 122X2 and outputs a distortion detection signal representing the distortion.

The distortion sensor 132Y1 is placed over the beam part 122Y1 on the left side (the negative side of the Y axis) of the central axis AX on the base part 131A. The distortion sensor 132Y1 detects distortion caused in the beam part 122Y1 and outputs a distortion detection signal representing the distortion.

The distortion sensor 132Y2 is placed over the beam part 122Y2 on the right side (the positive side of the Y axis) of the central axis AX on the base part 131A. The distortion sensor 132Y2 detects distortion caused in the beam part 122Y2 and outputs a distortion detection signal representing the distortion.

The spacer 140 is a flat plate-shaped member provided between the operation input part 200 and the base 120. The spacer 140 forms a space for installing the load detector 130 between the operation input part 200 and the base 120. Specifically, the spacer 140 has a thickness slightly larger than the maximum thickness of the load detector 130. Furthermore, the spacer 140 has an opening 140A that is shaped to conform to the outer periphery of the load detector 130 (the base part 131A and the lead part 131B). Accordingly, the load detector 130 (the base part 131A and the lead part 131B) can be installed within the opening 140A of the spacer 140 between the operation input part 200 and the base 120.

(Configuration of Operation Input Part 200)

Figure 5:
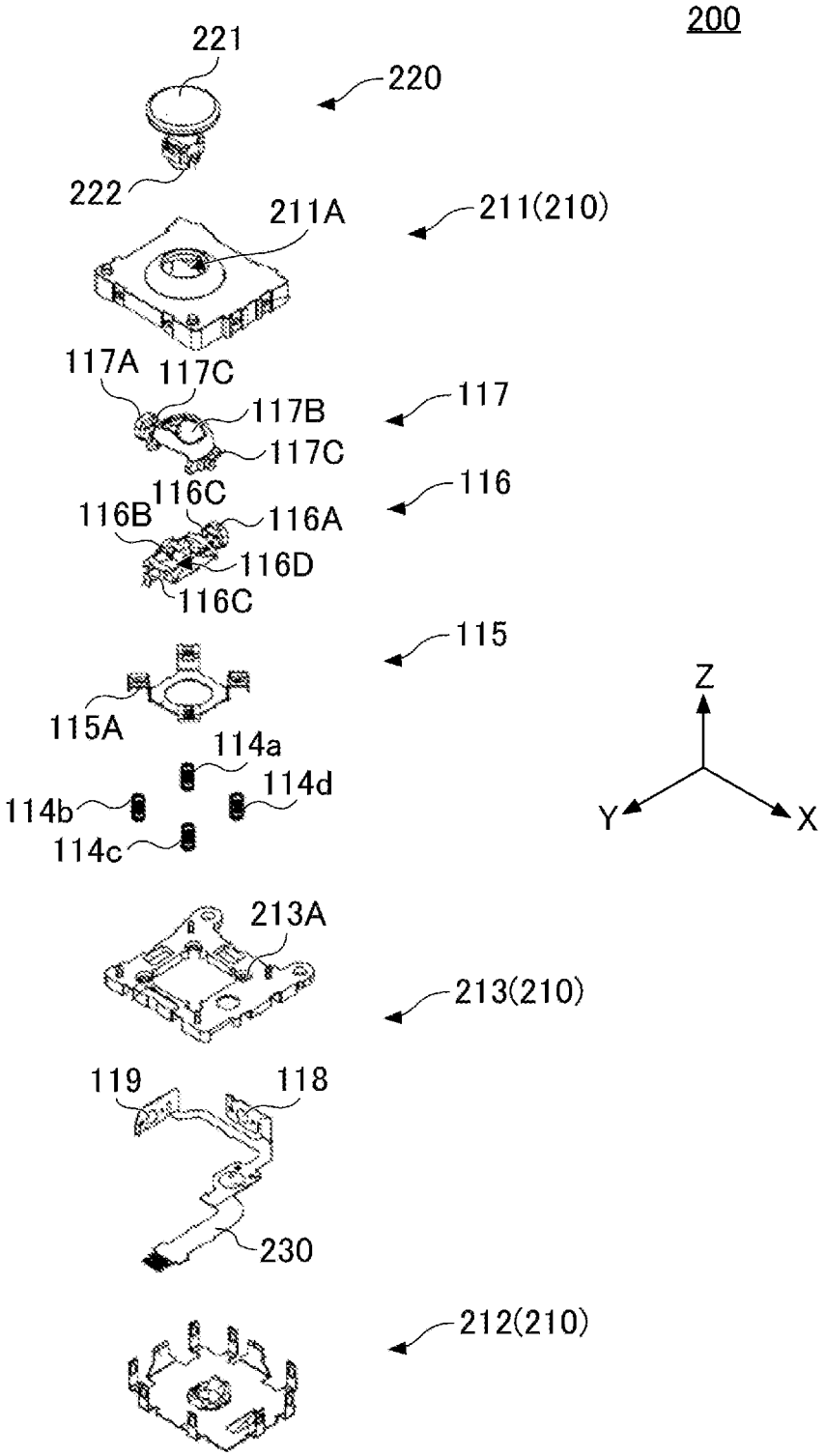
FIG. 5 is an exploded perspective view of an example configuration of an operation input part of the multidirectional input device according to the first embodiment.

FIG. 5 is an exploded perspective view of an example configuration of the operation input part 200 of the multidirectional input device 10 according to the first embodiment.

As illustrated in FIG. 5, the multidirectional input device 10 includes the case 210. The case 210 includes an upper case 211, a lower case 212, and a middle case 213. The upper case 211 includes the opening 211A, through which the operating member 220 vertically passes. The upper case 211, the lower case 212, and the middle case 213 are assembled into the case 210 such that the case 210 has a box shape with an internal storage (accommodation) space.

As illustrated in FIG. 5, in the multidirectional input device 10, the operating member 220 is provided on the top of the case 210. The operating member 220 includes an operating part 221 and a stem 222. The operating part 221 protrudes upward from the opening 211A of the upper case 211 to be positioned over the case 210. The operating part 221 is tilted by an operator. The stem 222 extends downward from the operating part 221 to pass through the opening 211A. The lower end of the stem 222 of the operating member 220 engages with a shaft 116B of a first linked member 116 described below.

Four coil springs 114*a*, 114*b*, 114*c*, and 114*d*, a spring holder 115, the first linked member 116, and a second linked member 117 are stored in the case 210 (between the upper case 211 and the middle case 213).

The four coil springs 114*a*, 114*b*, 114*c*, and 114*d* are examples of "return springs". The four coil springs 114*a*, 114*b*, 114*c*, and 114*d* are placed in through holes 213A of the middle case 213 in four directions with respect to the central axis AX in such a manner as to be vertically elastically deformable. The four coil springs 114*a*, 114*b*, 114*c*, and 114*d* preload the spring holder 115 upward with their own elastic recovery forces at their respective positions in the four directions with respect to the central axis AX.

The spring holder 115 is formed by processing a metal plate. The spring holder 115 includes four receivers 115A provided in four directions with respect to the central axis AX. The four receivers 115A receive the respective upper ends of the four coil springs 114*a*, 114*b*, 114*c*, and 114*d*. The spring holder 115 elastically contacts the lower surfaces of the first linked member 116 and the second linked member 117 to cause preload forces from the four coil springs 114*a*, 114*b*, 114*c*, and 114*d* to act on the first linked member 116 and the second linked member 117.

The first linked member 116 is an example of one of two "coupled parts". The first linked member 116 rotates in the X axis direction as the operating member 220 is tilted in the X axis direction. The first linked member 116 has an opening 116D that is rectangular in a top plan view. The columnar shaft 116B extending in the X axis direction is provided within the opening 116D. The shaft 116B engages with the lower end of the stem 222 of the operating member 220 to restrict the vertical movement of the operating member 220. The first linked member 116 includes a pair of columnar shafts 116C protruding in the Y axis direction, provided one at each Y axial end of the first linked member 116. The first linked member 116 is rotatably supported in the X axis direction by the upper case 211 with the shafts 116C rotatably supported by bearing parts (not depicted) provided in the upper case 211. A magnet 116A for detecting the rotation of the first linked member 116 is provided at the end of one of the shafts 116C. The lower surface of the first linked member 116 that contacts the spring holder 115 is a flat surface. When the operating member 220 is not operated, the lower surface of the first linked member 116 is in surface contact with the spring holder 115 because of the respective preload forces of the four coil springs 114*a*, 114*b*, 114*c*, and 114*d*. As a result, the first linked member 116 does not rotate in the X axis direction (that is, causes the operating member 220 to be in a neutral position).

The second linked member 117 is an example of the other "coupled part". The second linked member 117 rotates in the Y axis direction as the operating member 220 is tilted in the Y axis direction. The second linked member 117 is placed over and orthogonal to the first linked member 116. The second linked member 117 has an upward curving arch shape, and an opening 117B is formed along the length of its arch-shaped portion. The stem 222 of the operating member 220 passes through the opening 117B. The second linked member 117 includes a pair of columnar shafts 117C protruding in the X axis direction, provided one at each X axial end of the second linked member 117. The second linked member 117 is rotatably supported in the Y axis direction by the upper case 211 with the shafts 117C rotatably supported by bearing parts (not depicted) provided in the upper case 211. A magnet 117A for detecting the rotation angle of the second linked member 117 is provided at the end of one of the shafts 117C. The lower surface of the second linked member 117 that contacts the spring holder 115 is a flat surface. When the operating member 220 is not operated, the lower surface of the second linked member 117 is in surface contact with the spring holder 115 because of the respective preload forces of the four coil springs 114*a*, 114*b*, 114*c*, and 114*d*. As a result, the second linked member 117 does not rotate in the Y axis direction (that is, causes the operating member 220 to be in the neutral position).

Furthermore, as illustrated in FIG. 5, a rotation sensor 118 and a rotation sensor 119 are provided in the case 210 (between the middle case 213 and the lower case 212) of the multidirectional input device 10. According to the present embodiment, giant magnetoresistance (GMR) elements are used as the rotation sensor 118 and the rotation sensor 119.

The rotation sensor 118 is positioned opposite the magnet 116A provided on the first linked member 116 on the FPC 230, and detects the rotation angle of the first linked member 116 (that is, the tilt angle of the operating member 220 in the X axis direction). The rotation sensor 118 outputs a rotation angle detection signal that represents the rotation angle of the first linked member 116 via the FPC 230.

The rotation sensor 119 is positioned opposite the magnet 117A provided on the second linked member 117 on the FPC 230, and detects the rotation angle of the second linked member 117 (that is, the tilt angle of the operating member 220 in the Y axis direction). The rotation sensor 119 outputs a rotation angle detection signal that represents the rotation angle of the second linked member 117 via the FPC 230.

According to the multidirectional input device 10 configured as described above, when the operating member 220 is tilted, one or both of the first linked member 116 and the second linked member 117 rotate. As a result, a rotation angle detection signal commensurate with the tilt direction and the tilt angle of the operating member 220 is output from one or both of the rotation sensors 118 and 119 to the outside (for example, a controller 150 described below) via the FPC 230.

According to the multidirectional input device 10, when the tilting of the operating member 220 is canceled, the operating member 220 returns to the neutral position because of preload forces from the four coil springs 114*a*, 114*b*, 114*c*, and 114*d* via the spring holder 115, the first linked member 116, and the second linked member 117.

Furthermore, according to the multidirectional input device 10, not only when the operating member 220 is tilted, but also when a load is applied to the case 210, a distortion commensurate with the direction and magnitude of the applied load is caused in the four beam parts 122X1, 122X2, 122Y1, and 122Y2 of the base 120 with the columnar part 121 being fixed. In this case, the four distortion sensors 132X1, 132X2, 132Y1, and 132Y2 detect distortions in the four beam parts 122X1, 122X2, 122Y1, and 122Y2, respectively. Then, distortion detection signals are output from the four respective distortion sensors 132X1, 132X2, 132Y1, and 132Y2 to the outside (for example, the controller 150 described below) via the FPC 131.

(Electrical Connection Configuration of Multidirectional Input Device 10)

Figure 6:
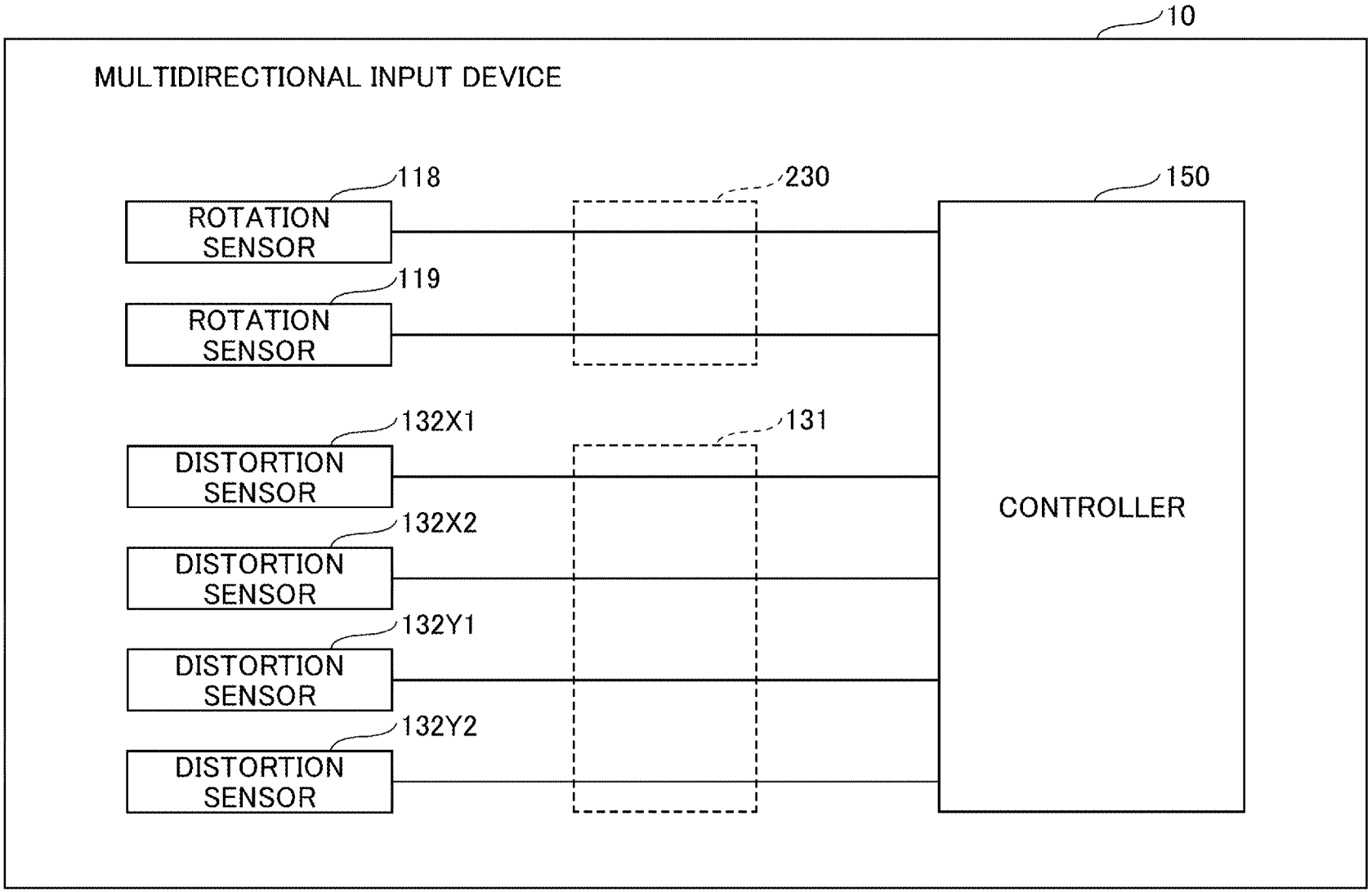
FIG. 6 is a block diagram illustrating an electrical connection configuration of the multidirectional input device according to the first embodiment.

FIG. 6 is a block diagram illustrating an electrical connection configuration of the multidirectional input device 10 according to the first embodiment. As illustrated in FIG. 6, the multidirectional input device 10 further includes the controller 150 in addition to the rotation sensors 118 and 119 and the distortion sensors 132X1, 132X2, 132Y1, and 132Y2.

The controller 150 is an example of a "controller". The controller 150 performs various kinds of control on the multidirectional input device 10. Examples of the controller 150 include an integrated circuit (IC).

The controller 150 is connected to the rotation sensors 118 and 119 via the FPC 230. The controller 150 receives rotation angle detection signals output from the rotation sensors 118 and 119 via the FPC 230.

Furthermore, the controller 150 is connected to the distortion sensors 132X1, 132X2, 132Y1, and 132Y2 via the FPC 131. The controller 150 receives distortion detection signals output from the distortion sensors 132X1, 132X2, 132Y1, and 132Y2 via the FPC 131.

Furthermore, for example, the controller 150 can detect the tilt angle of the operating member 220 in the X axis direction based on the rotation angle detection signal received from the rotation sensor 118.

Furthermore, for example, the controller 150 can detect the tilt angle of the operating member 220 in the Y axis direction based on the rotation angle detection signal received from the rotation sensor 119.

Furthermore, for example, the controller 150 can detect a load applied to the case 210 in each direction (in each of the X axis direction, the Y axis direction, and the Z axis direction) based on the distortion detection signals received from the respective distortion sensors 132X1, 132X2, 132Y1, and 132Y2.

Furthermore, for example, the controller 150 can determine operation details of the operating member 220 based on the detected load.

For example, when the amount of distortion in a certain direction in the XY plane increases, the controller 150 determines that the operating member 220 is tilted in the direction. In this case, the controller 150 can determine the tilt angle of the operating member 220 according to the amount of distortion.

Furthermore, when the amount of distortion in each of four directions in the XY plane approximately equally increases, the controller 150 determines that the operating member 220 is tilted in the Z axis direction. In this case, the controller 150 can determine a pressing load applied to the operating member 220 in the Z axis direction according to the amount of distortion in each of the four directions in the XY plane.

Furthermore, for example, when the amount of distortion further increases in a certain direction with the operating member 220 being physically tilted to the maximum angle in the direction, the controller 150 determines that the operating member 220 is further pressed in the direction. In this case, the controller 150 can determine the magnitude of the pressing load further applied to the operating member 220 according to the amount of distortion.

Furthermore, for example, the controller 150 can determine whether the operator is in contact with the operating member 220 based on the amount of distortion in each of the four directions.

For example, when the amount of distortion in at least one of the four directions is not approximately zero, the controller 150 determines that the operator is in contact with the operating member 220.

Furthermore, for example, when the amount of distortion in each of the four directions is approximately zero, the controller 150 determines that the operator is not in contact with the operating member 220. In this case, regardless of rotation angle detection signals, the controller 150 can determine that the operating member 220 is in a non-operating position. Accordingly, the controller 150 can perform correction by using values of the rotation angle detection signals at that time as the origin of the rotation angle detection signals.

Furthermore, for example, the controller 150 can determine whether the operator is in contact with the case 210 based on the amount of distortion in each of the four directions.

As described above, the multidirectional input device 10 according to the first embodiment includes the operation input part 200, the base 120, and the load detector 130. The operation input part 200 includes the operating member 220, the first linked member 116, and the second linked member 117 configured to convert a tilt of the operating member 220 into two rotation angles orthogonal to each other, the coil springs 114*a*, 114*b*, 114*c*, and 114*d* configured to return the operation stick to an upright position, and the case 210 accommodating the first linked member 116, the second linked member 117, the coil springs 114*a*, 114*b*, 114*c*, and 114*d*, and a part of the operating member 220. The base 120 has a plate shape and is provided below the case 210. The load detector 130 is provided on the base 120 and is configured to detect a load applied to the case 210.

Accordingly, when the operating member 220 is in the non-operating position, a load detected by the load detector 130 is approximately zero. Therefore, regardless of rotation angle detection signals, the multidirectional input device 10 according to the first embodiment can determine that the operating member 220 is in the non-operating position. Accordingly, in the multidirectional input device 10 according to the first embodiment, whether or not the operating member 220 is in the origin position can be readily determined.

The multidirectional input device 10 according to the first embodiment further includes the columnar part 121 at the base 120. The load detector 130 includes the four distortion sensors 132X1, 132X2, 132Y1, and 132Y2 configured to detect distortions caused around the columnar part 121.

Accordingly, the multidirectional input device 10 according to the first embodiment can improve the accuracy of detecting a load applied to the case 210. Further, an existing load detector including four distortion sensors can be used as the load detector 130.

In the multidirectional input device 10 according to the first embodiment, the columnar part 121 is integrated with the base 120, and the distortion sensors 132X1, 132X2, 132Y1, and 132Y2 are provided in four directions around the columnar part 121 on the base 120.

Accordingly, the multidirectional input device 10 according to the first embodiment can improve the accuracy of detecting the tilting of the operating member 220 in horizontal directions (the X axis direction and the Y axis direction).

In the multidirectional input device 10 according to the first embodiment, the coil springs 114*a*, 114*b*, 114*c*, and 114*d* are provided in four directions.

Accordingly, a load in a horizontal direction (the X axis direction or the Y axis direction) input from the operating member 220 is less likely to be converted into a force in a vertical direction (the Z axis direction). Therefore, the multidirectional input device 10 according to the first embodiment can improve the accuracy of detecting loads in the horizontal directions.

The multidirectional input device 10 according to the first embodiment further includes the rotation sensors 118 and 119 configured to detect rotation angles of the first linked member 116 and the second linked member 117, and the controller 150 configured to, at a time when the load detector 130 does not detect a load in a horizontal direction, use values of outputs of the rotation sensors 118 and 119 at the time, as the origin of the outputs of the rotation sensors 118 and 119, to perform correction.

Accordingly, in the multidirectional input device 10 according to the first embodiment, even if the operating member is not in an exact neutral position when not operated, the origin can be corrected by using values of rotation angle detection signals of the rotation sensors 118 and 119 at the time.

Second Embodiment

Figure 7:
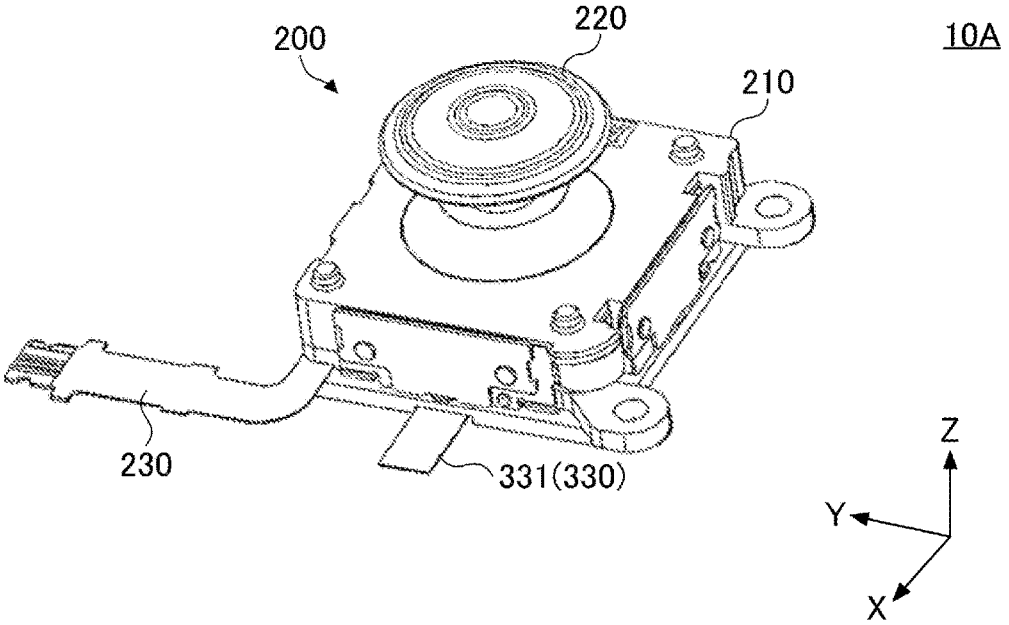
FIG. 7 is a top-side perspective view of a multidirectional input device according to a second embodiment.
Figure 8:
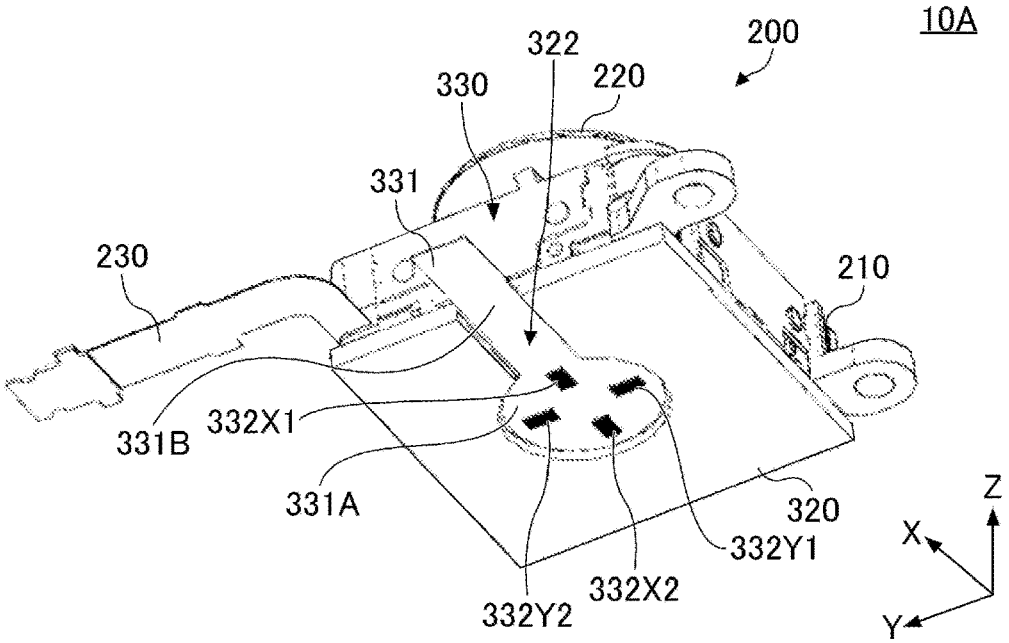
FIG. 8 is a bottom-side perspective view of the multidirectional input device according to the second embodiment.
Figure 9:
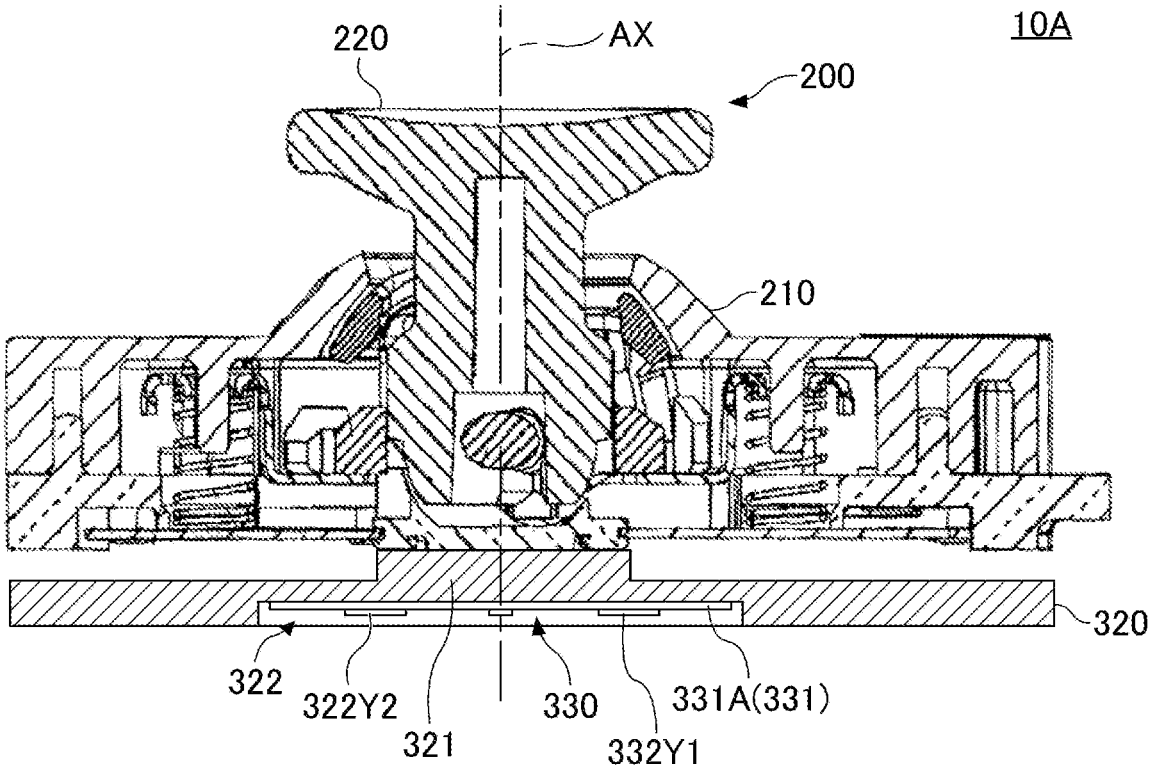
FIG. 9 is a cross-sectional view of the multidirectional input device according to the second embodiment.

Next, a second embodiment will be described with reference to FIG. 7 through FIG. 9. FIG. 7 is a top-side perspective view of a multidirectional input device 10A according to the second embodiment. FIG. 8 is a bottom-side perspective view of the multidirectional input device 10A according to the second embodiment. FIG. 9 is a cross-sectional view of the multidirectional input device 10A according to the second embodiment.

In the following, the multidirectional input device 10A according to the second embodiment will be described with respect to differences from the multidirectional input device 10 according to the first embodiment. That is, any configuration and effect of the multidirectional input device 10A, not described below, are the same as those of the multidirectional input device 10.

The multidirectional input device 10A according to the second embodiment differs from the multidirectional input device 10 according to the first embodiment in that the multidirectional input device 10A includes a base 320 and a load detector 330 below the case 210 of the operation input part 200, instead of the base 120 and the load detector 130.

The base 320 is a flat plate-shaped member attached to the bottom of the case 210 of the operation input part 200. The base 320 includes a columnar part 321 and a recess 322.

The columnar part 321 has a cylindrical shape and is provided at the center of the top surface of the base 320 (coaxially with the central axis AX of the operating member 220) so as to protrude upward. As illustrated in FIG. 9, the top surface of the columnar part 321 is fixed to the bottom surface of the case 210 by attaching the base 320 to the bottom of the case 210.

The recess 322 is formed in the bottom surface of the base 320, and is shaped to conform to the outer periphery of an FPC 331 of the load detector 330. The load detector 330 is disposed in the recess 322.

The load detector 330 is provided in the recess 322 formed in the bottom surface of the base 320. The load detector 330 detects distortions caused around the columnar part 321 of the base 320 by a load applied to the case 210, and outputs distortion detection signals representing the detected distortions to the outside. The load detector 330 includes the FPC 331 and four distortion sensors 332X1, 332X2, 332Y1, and 332Y2.

The FPC 331 is a flexible interconnect member having a film shape. The FPC 331 includes a base part 331A and a lead part 331B. The base part 331A has a circular shape, and is disposed in the recess 322 and located at the center of the base 320 (coaxially with the central axis AX of the operating member 220). The four distortion sensors 332X1, 332X2, 332Y1, and 332Y2 are disposed on the bottom surface (on the −Z axis side) of the base part 331A, and arranged in four directions around the columnar part 321. The lead part 331B extends horizontally and rectilinearly from the base part 331A to the outside of the case 210. The FPC 331 outputs distortion detection signals, output from the four respective distortion sensors 132X1, 132X2, 132Y1, and 132Y2, to the outside.

The four distortion sensors 332X1, 332X2, 332Y1, and 332Y2 are disposed in the four directions with respect to the central axis AX on the bottom surface of and around the columnar part 321 of the base part 331A of the FPC 331, and detect distortions caused around the columnar part 321 of the base 320 by a load applied to the case 210.

Specifically, the distortion sensor 332X1 is disposed on the front side (+X axis side) of the bottom surface of the base part 331A relative to the columnar part 321. The distortion sensor 332X1 detects distortion caused in a part on the front side of the base 320 relative to the columnar part 321, and outputs a distortion detection signal representing the distortion.

The distortion sensor 332X2 is disposed on the rear side (−X axis side) of the bottom surface of the base part 331A relative to the columnar part 321. The distortion sensor 332X2 detects distortion caused in a part on the rear side of the base 320 relative to the columnar part 321, and outputs a distortion detection signal representing the distortion.

The distortion sensor 332Y1 is disposed on the left side (−Y axis side) of the bottom surface of the base part 331A relative to the columnar part 321. The distortion sensor 332Y1 detects distortion caused in a part on the left side of the base 320 relative to the columnar part 321, and outputs a distortion detection signal representing the distortion.

The distortion sensor 332Y2 is disposed on the right side (+Y axis side) of the bottom surface of the base part 331A relative to the columnar part 321. The distortion sensor 332Y2 detects distortion caused in a part on the right side of the base 320 relative to the columnar part 321, and outputs a distortion detection signal representing the distortion.

In the multidirectional input device 10A having the above-described configuration according to the second embodiment, not only when the operating member 220 is tilted, but also when a load is applied to the case 210, the load is transmitted to the columnar part 321 of the base 320 and a distortion commensurate with the direction and magnitude of the applied load is caused around the columnar part 321 of the base 120. In this case, the four distortion sensors 332X1, 332X2, 332Y1, and 332Y2 detect distortions in the four respective parts around the columnar part 321 of the base 320. Then, distortion detection signals are output from the four respective distortion sensors 332X1, 332X2, 332Y1, and 332Y2 to the outside (for example, the controller 150 illustrated in FIG. 6) via the FPC 331.

Although the embodiments of the present invention have been described above, the present invention is not limited to the above-described embodiments, and variations and modifications may be made without departing from the scope of the present invention.

For example, in each of the above-described embodiments, a load applied to the case 210 is detected by the distortion sensors provided below the case 210. However, the configuration for detecting a load applied to the case 210 is not limited thereto, and a load applied to the case 210 may be detected by pressure sensors provided below the case 210.

Further, for example, in the above-described second embodiment, the columnar part 321 is integrated with the base 320; however, the present invention is not limited thereto, and the columnar part 321 may be integrated with the case 210. That is, the columnar part 321 may be provided on the bottom surface of the case 210 so as to protrude downward. In this case, the distortion sensors may be provided around the columnar part 321 on the bottom surface of the case 210. The accuracy of detecting the tilting of the operating member 220 in horizontal directions (the X axis direction and the Y axis direction) can be improved in this case as well.

Further, for example, in the above-described embodiments, the bases 120 and 320 are separated from the case 210; however, the present invention is not limited thereto, and each of the bases 120 and 320 may be integrated with the case 210.

Further, for example, in the above-described embodiments, the operation input part 200 includes the rotation sensors 118 and 119; however, the present invention is not limited thereto, and the operation input part 200 does not necessarily include the rotation sensors 118 and 119. This is because the controller 150 can determine the tilt direction and the tilt angle of the operating member 220 based on distortion detection signals received from the respective distortion sensors.

Further, for example, in the above-described embodiments, the four distortion sensors are disposed around the columnar part; however, the present invention is not limited thereto, and three or less distortion sensors or five or more distortion sensors may be disposed around the columnar part.

Furthermore, for example, the four coil springs 114*a*, 114*b*, 114*c*, and 114*d*, which are vertically elastically deformable and disposed in four directions with respect to the central axis AX of the operating member 220, are used as examples of the "return springs" for returning the operating member 220 to the neutral position according to the above-described embodiment; however, the "return springs" are not limited thereto. For example, as other examples of the "return springs", multiple coil springs that are horizontally elastically deformable, preloaded such that the rotational shafts of the two coupled parts rotate in a returning direction via respective levers, may be used. In this case as well, a load in a horizontal direction (the X axis direction or the Y axis direction) input from the operating member 220 is less likely to be converted into a force in a vertical direction (the Z axis direction). Therefore, the accuracy of detecting a load in a horizontal direction can be improved.

What is claimed is:

1. A multidirectional input device comprising:

an operation input part including an operation stick configured to be operated and pressed by a user, two coupled parts configured to convert a tilt of the operation stick into two rotation angles orthogonal to each other, at least one return spring configured to return the operation stick to an upright position, and a frame accommodating the two coupled parts, the at least one return spring, and a part of the operation stick;

a base having a plate shape, the base being provided below the frame and fixed to the frame;

a columnar part provided below the base;

a load detector provided on the frame or the base and configured to detect a load applied to the frame, the load detector including a plurality of distortion sensors configured to detect distortions;

one or more rotation sensors configured to detect rotation angles of the two coupled parts; and a controller configured to determine, at a time when the load detector does not detect a load in a horizontal direction, that the operation stick is in a non-operated state, and use values of outputs of the one or more rotation sensors at the time, as an origin of the outputs of the one or more rotation sensors, to perform correction, the controller being further configured to determine that the operation stick is further pressed when an amount of distortions detected by the plurality of distortion sensors increases in a state where the operation stick is tilted to a maximum angle, and determine a pressing load applied to the operation stick according to an increase in the amount of distortions.

2. The multidirectional input device according to claim 1, wherein the columnar part is provided at a center with respect to the frame or the base, and wherein the plurality of distortion sensors are configured to detect distortions caused around the columnar part.

3. The multidirectional input device according to claim 2, wherein the columnar part is integrated with the base, and the distortion sensors are provided in four directions around the columnar part on the base.

4. The multidirectional input device according to claim 2, wherein the columnar part is integrated with the frame, and the distortion sensors are provided in four directions around the columnar part on the frame.

5. The multidirectional input device according to claim 1, wherein the at least one return spring is provided in each of four directions.

6. The multidirectional input device according to claim 1, wherein the at least one return spring includes a plurality of return springs provided in horizontal directions.

7. The multidirectional input device according to claim 1, wherein the plurality of distortion sensors are provided in four directions around the columnar part, and wherein the controller is further configured to determine that the operation stick is pressed in a vertical direction when the amount of distortions in each of the four directions equally increases.

* * * * *